United States Patent [19]

Marbach

[11] Patent Number: 4,729,274

[45] Date of Patent: Mar. 8, 1988

[54] STRIP-SHAPED KNIFE FOR USE IN PUNCHING MACHINES AND THE LIKE

[76] Inventor: Karl Marbach, Silcherstr. 28, D-7102 Weinsberg, Fed. Rep. of Germany

[21] Appl. No.: 896,120

[22] Filed: Aug. 12, 1986

[51] Int. Cl.[4] ..... B26F 1/44

[52] U.S. Cl. ..... 83/684; 76/107 C; 83/652; 83/697

[58] Field of Search ..... 76/107 C; 83/684, 697, 83/652–657

[56] References Cited

U.S. PATENT DOCUMENTS 1,837,524 12/1931 Braden ..... 76/107 C 2,211,213 8/1940 Lindholm ..... 83/652

2,276,376 3/1942 Deubel ..... 76/107 C X 3,411,208 11/1968 Malm ..... 83/652 X

*Primary Examiner*—Frank T. Yost

*Attorney, Agent, or Firm*—Peter K. Kontler

[57] ABSTRACT

A punching tool wherein the knife is a strip of steel and has a cutting edge flanked by two mutually inclined concave facets. The facets are disposed between the cutting edge and two lateral surfaces which have concave portions adjacent the respective facets. Those portions of the knife which are disposed between the facets and the concave portions of the respective lateral surfaces are rounded.

16 Claims, 4 Drawing Figures

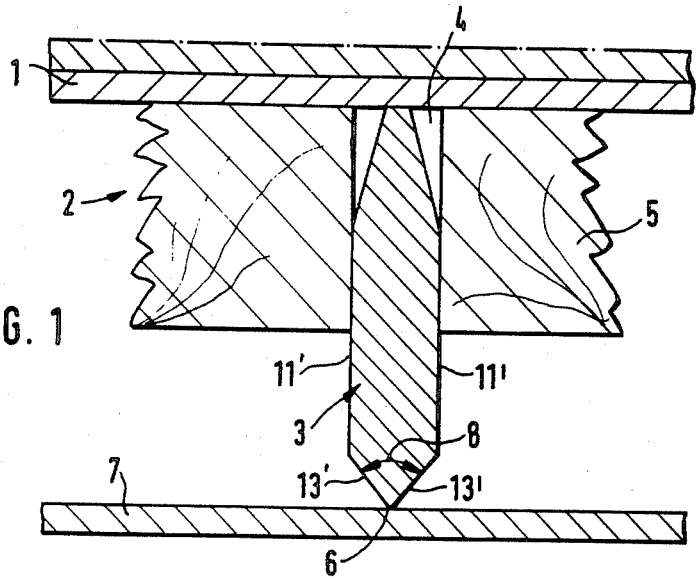
FIG. 1
FIG. 2
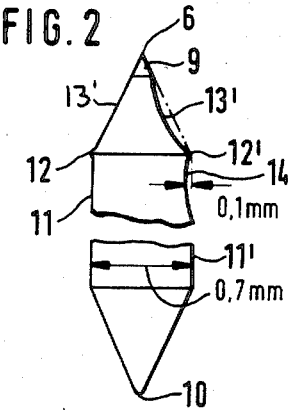
FIG. 3
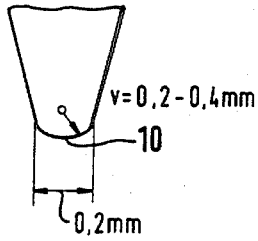
FIG. 4
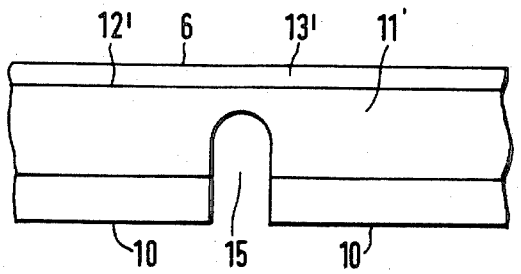

STRIP-SHAPED KNIFE FOR USE IN PUNCHING MACHINES AND THE LIKE

BACKGROUND OF THE INVENTION

The invention relates to improvements in cutting tools in general, and more particularly to improvements in cutting tools which can be used with particular advantage in punching or stamping machines. Still more particularly, the invention relates to improvements in cutting tools of the type wherein a substantially strip-shaped knife is provided with a longitudinally extending cutting edge flanked by two mutually inclined facets.

Cutting tools utilizing strip-shaped knives of steel or the like are disclosed in German Pat. No. 31 35 980. The dimensions of the facets flanking the cutting edge are selected in such a way that the facets penetrate into the material which is being severed so that the material comes into contact with the transition zones between the rearmost portions of the facets and the adjacent foremost portions of the lateral surfaces of the knife. In many instances, the transition zones between the facets and the lateral surfaces are rough or exhibit burrs. Certain knives actually exhibit pronounced beads between the facets and the adjacent foremost portions of the lateral surfaces. Such rough portions or beads are likely to damage and/or deface the material in the region of the cut. Problems are likely to arise when the knife is used to sever workpieces which are made of cardboard and have a thickness in the range of 1 mm. Such materials can consist of kraft pulp. The rough or uneven transition zones between the facets and the lateral surfaces of the knife tend to rip the outermost layers of the workpieces.

Proposals to overcome the just discussed drawbacks of conventional knives include the reduction of the angle between the mutually inclined facets of the knife. However, the angle between the facets cannot be decreased at will because, if the angle is reduced to less than 50 degrees, the knife is subjected to excessive stresses whenever its cutting edge strikes against the workpiece and/or against the anvil on which the workpiece rests. This can considerably reduce the stability and the useful life of the knife.

In accordance with another earlier proposal, the thickness of the strip-shaped knife is increased so that the knife is capable of standing more pronounced stresses even if the angle between the facets is relatively small. However, such knives are likely to deface the workpieces because the tensional stress at the rear side of the workpiece increases proportionately with increasing thickness of the knife. A relatively thick knife is very likely to cause the workpiece (such as a cardboard with two outer layers) to crack so that the product must be discarded.

OBJECTS AND SUMMARY OF THE INVENTION

An object of the invention is to provide a cutting tool with a substantially strip-shaped knife which can be used for long periods of time even though its thickness need not exceed the thickness of conventional knives and which is capable of making clean cuts even if it penetrates into the material of a workpiece beyond the rearmost portions of the facets which flank the cutting edge.

A further object of the invention is to provide a cutting tool wherein the knife can make clean cuts even though the angle between its facets need not be reduced below 50 degrees.

An additional object of the invention is to provide a novel and improved method of shaping the strip-shaped knife of a cutting tool, particularly a stamping or punching tool.

The invention resides in the provision of a cutting tool, particularly a punching or stamping tool, which comprises a substantially strip-shaped knife having a cutting edge, a pair of lateral surfaces and a substantially concave facet between the cutting edge and each lateral surface. The lateral surfaces are inclined with respect to the corresponding facets, and each lateral surface has a concave portion which is adjacent the corresponding facet. The knife can be made of or can contain steel.

The concave portions of the lateral surfaces define grooves which extend in substantial parallelism with the cutting edge and each of which has a depth of between approximately 0.075 mm and 0.125 mm, preferably approximately 0.1 mm.

Each concave portion preferably has a substantially constant radius of curvature, the radius being preferably in the range of approximately 10 mm.

The knife is preferably rounded between each concave portion and the respective facet. Furthermore, the knife is preferably hardened in the region of the cutting edge. Those portions of the facets which are immediately adjacent the cutting edge are or can be substantially flat so that the hardened portion of the knife is flanked by two mutually inclined flat elongated portions of the facets. The radius of curvature of each facet (and more particularly of the concave portion of each facet) is or can approximately 30 mm. The back of the knife (which is disposed opposite the cutting edge) is preferably provided with a substantially convex cross-sectional outline. The radius of curvature of such outline can be in the range of between 0.2 and 0.4 mm.

At least a portion of the knife is preferably surface-hardened, for example, by shot-peening.

The mutual inclination of the facets need not exceed 52 degrees. Furthermore, the thickness of the knife between its lateral surfaces need not appreciably exceed 0.7 mm.

The novel features which are considered as characteristic of the invention are set forth in particular in the appended claims. The improved knife itself, however, both as to its construction and the mode of forming the same, together with additional features and advantages thereof, will be best understood upon perusal of the following detailed description of certain specific embodiments with reference to the accompanying drawing.

BRIEF DESCRIPTION OF THE DRAWING

FIG. 1 is a section view of a cutting tool having a knife or cutter which embodies the present invention;

FIG. 2 is an end elevational view of a knife the right-hand portion of which is configurated in accordance with the present invention;

FIG. 3 is an enlarged view of the back of the improved knife; and

FIG. 4 is a fragmentary side elevational view of the improved knife.

DESCRIPTION OF THE PREFERRED EMBODIMENTS

FIG. 1 shows a portion of a cutting tool 2 which comprises a hardened steel plate 1 supporting a holder 5 for an elongated strip-shaped cutter or knife 3 which can be made of steel. The holder 5 has a slot 4 for the rear portion of the knife 3. For example, the holder 5 can be made of plywood. The manner in which the tool 2 is reciprocable up and down, as seen in FIG. 1, so that the cutting edge 6 of the knife can penetrate into and through a workpiece (not shown) which rests on an anvil 7 forms no part of the present invention. Any conventional device for imparting motion to the holder 5 can be used without any or with negligible modifications. For example, the workpiece which is to be severed by the cutting edge 6 of the cutter or knife 3 can constitute a sheet of cardboard, paperboard or the like. The thickness of the knife 3 between its substantially parallel lateral surfaces 11' can equal or approximate 0.7 mm, and the height of the knife between its cutting edge 6 and its convex back 10 can be in the range of 23.8 mm.

The angle between the facets (note the facets 13' which flank the cutting edge 6 of the improved knife 3) of a conventional knife is in the range of 52–60 degrees. The angle (denoted by the character 8) between the facets 13' of the improved knife 6 need not exceed 52 degrees.

That portion of the knife 3 which is immediately adjacent the cutting edge 6 is denoted by the character 9 and is preferably induction-hardened so that it exhibits a Rockwell hardness of between 50 and 52 or a Vickers hardness of 5100–5500. On the other hand, the region of the rounded or convex back 10 of the knife 3 is preferably softened (for example by annealing) so that its Rockwell hardness need not exceed 36–38 which would correspond to a Vickers hardness of approximately 3000 newtons per $mm^2$. The provision of a relatively soft back 10 is desirable and advantageous because, if the knife 3 is subjected to a very pronounced stress while its cutting edge strikes against a workpiece or against the adjacent surface of the anvil 7, the rearmost portion of the knife in the region of the back 10 yields so that the orientation or inclination of the entire knife 3 can change to thereby reduce the likelihood of localized overstressing. Some plastic deformation of the knife 3 in the region of the back 10 further renders it possible to compensate for eventual tolerances in the making of the knife. Proper orientation or alignment of the knife enhances the quality of the cuts which are made by the cutting edge 6 in cooperation with the anvil 7. Moreover, it is not necessary to carry out a lengthy and complex advance orientation or alignment of the knife 3; the knife orients itself automatically when its cutting edge 6 strikes first against a workpiece and thereupon against the adjacent surface of the anvil 7.

The right-hand portion of FIG. 2 shows the configuration of the improved knife 3 as compared with the configuration of a conventional knife (see the left-hand half of FIG. 2). The facets 13' of the improved knife 3 have a concave shape as compared with the flat facets 13 of conventional knifes. Furthermore, each lateral surface 11' of the improved knife 3 has a concave portion 14 which is adjacent a rounded portion 12' between the lateral surface and the respective concave facet 13'. This is on contrast to the rough or even beaded transition zone 12 between the facet 13 and the respective lateral surface 11 of a conventional knife. The depth of the recesses or grooves which are defined by the concave portions 14 of the lateral surfaces 11' can be in the range of between 0.075 and 0.125 mm, preferably in the range of approximately 0.1 mm. The facets 13' and the concave portions 14 can be formed by grinding. Rounding of the knife 3 in the regions 12' between the lateral surfaces 11' and facets 13' eliminates the burrs 12 or analogous protuberances or projections which would be likely to damage or deface the workpiece. The provision of concave facets 13' facilitates penetration of the cutting edge 6 into a workpiece which rests on or abuts against the anvil 7. The radius of curvature of each concave portion 14 can be in the range of 10 mm. Furthermore, there is preferably a gradual transition from the concave portion 14 into the adjacent flat portion of the respective lateral surface 11' as well as from the concave portion 14 into the adjacent outermost or rearmost portion of the respective facet 13'. Such configuration of the knife 3 reduces the resistance which the knife encounters during penetration into a sheet of cardboard or into another workpiece. This is due to the fact that the knife 3 which has the improved configuration generates less friction and, accordingly, is also less likely to damage or deface the edges bounding the cut in a workpiece. The radii of curvature of the concave portions 14 are preferably constant.

Those portions of the facets 13' which are immediately adjacent the hardened foremost portion 9 of the knife 3 are preferably flat or substantially flat. This can be seen in the upper portion of FIG. 2. The portion 9 can be hardened by induction hardening or by resorting to any other suitable technique. The back 10 is preferably softened by annealing or by relying upon any other suitable technique. The radius of curvature of the convex surface bounding the back 10 can be between 0.2 and 0.4 mm.

As a rule, the strip-shaped knife of a stamping or punching tool must be provided with cutouts in the form of notches one of which is shown at 15 in FIG. 4. Such notches are machined into the back 10 of the knife, and the resulting deformation of the material around the notch results in the development of internal stresses which, combined with stresses that develop when the tool is in actual use, can lead to breaks across the respective portion of the knife. It has been found that the tendency of the knife which has one or more notches 15 to break in the region of a notch can be reduced considerably if a portion or the entire external surface of the knife is hardened, particularly shot-peened.

The improved knife can make clean cuts and its useful life is longer than that of conventional knives. This is attributable to the concavity of the facets 13' as well as to the concavity of portions 14 of the lateral surfaces 11' in the region of transition zones 12' as shown in FIG. 2. The edges bounding the cut in a workpiece slide more readily along the transition zones 12' and need not or do not contact the lateral surfaces 11' even if the knife is compelled or caused to penetrate well into the material of the workpiece so that the workpiece extends toward the back 10 beyond the rounded transition zones 12'. Reduction of friction between the workpiece and the surfaces of the knife results in a reduction of wear upon the knife as well as in the making of cleaner cuts. Furthermore, the layer at the rear side of the workpiece is less likely to burst in response to penetration of the cutting edge 6 into the workpiece.

By selecting the depth of grooves or recesses which are bounded by concave portions 14 in the aforedescribed manner (preferably in the range 0.1 mm), the knife 3 exhibits the aforediscussed advantages but is not unduly weakened in the region of the concave portions 14. By selecting a relatively large radius of curvature (e.g., 10 mm) for each of the concave portions 14, one ensures that the transitions between the concave portions 14 and the major portions of the lateral surfaces 11', as well as between the concave portions 14 and the adjacent rear portions of the respective facets 13', are gradual and sufficiently smooth to avoid the development of burrs or similar undesirable projections. Moreover, such selection of radii of curvature for the concave portions 14 does not entail an excessive weakening of the knife behind the rounded portions 12'.

The aforediscussed selection of the configuration of facets 13' in such a way that the facet portions flanking the hardened portion 9 of the knife 3 are flat or substantially flat prolongs the useful life of the knife and of the entire tool. One presently preferred mode of hardening is high-frequency or induction hardening. Facets 13' with radii of curvature in the range of approximately 30 mm have been found to be very satisfactory.

The utilization of a knife having a relatively soft back 10 is desirable and advantageous for the aforediscussed reasons, i.e., particularly to compensate for eventual deviations from the optimum dimensions. It is desirable and advantageous to shape the knife in such a way that it includes two exactly mirror symmetrical halves. The provision of a relatively soft back is already suggested in the aforementioned German Pat. No. 31 35 980. The utilization of a back having a convex surface further enhances the ability of the knife to compensate for eventual manufacturing tolerances. As mentioned above, the radius of curvature of the surface bounding the convex back 10 can be between 0.2 and 0.4 mm if the thickness of the knife 3 between the lateral surfaces 11' is approximately 0.7 mm.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

I claim:

1. A cutting tool, particularly a punching or stamping tool, comprising a substantially strip-shaped knife having a cutting edge, a pair of lateral surfaces and a substantially concave facet between said edge and each of said lateral surfaces, said lateral surfaces being inclined with respect to the corresponding facets and each of said lateral surfaces having a concave portion adjacent the corresponding facet.

2. The tool of claim 1, wherein said knife consists of or contains steel.

3. The tool of claim 1, wherein said concave portions define grooves extending in substantial parallelism with said edge and each having a depth of between approximately 0.075 mm and 0.125 mm.

4. The tool of claim 3, wherein said depth is approximately 0.1 mm.

5. The tool of claim 1, wherein each of said concave portions has a substantially constant radius of curvature.

6. The tool of claim 5, wherein said radius of curvature is approximately 10 mm.

7. The tool of claim 1, wherein said knife is rounded intermediate each of said concave portions and the respective facet.

8. The tool of claim 1, wherein said knife is hardened in the region of said cutting edge.

9. The tool of claim 1, wherein each of said facets has a substantially flat portion immediately adjacent said cutting edge and said knife is hardened in the region of said cutting edge between said flat portions of the facets.

10. The tool of claim 1, wherein the radius of curvature of each of said facets is approximately 30 mm.

11. The tool of claim 1, wherein said knife has a back which is disposed opposite said cutting edge and has a substantially convex cross-sectional outline.

12. The tool of claim 11, wherein said back has a radius of curvature in the range of 0.2 to 0.4 mm.

13. The tool of claim 1, wherein at least a portion of said knife is surface-hardened.

14. The tool of claim 13, wherein said portion of said knife is shot-peened.

15. The tool of claim 1, wherein said facets are inclined relative to each other at an angle of less than 52°.

16. The tool of claim 1, wherein the thickness of said knife between said lateral surfaces is approximately 0.7 mm.

* * * * *